US005704475A

United States Patent [19]

Jack

[11] Patent Number: 5,704,475

[45] Date of Patent: Jan. 6, 1998

[54] INFLATABLE GOLF CLUB PROTECTOR

[76] Inventor: William Jack, 605 Gristmill La., Durham, N.C. 27712

[21] Appl. No.: 636,868

[22] Filed: Apr. 23, 1996

[51] Int. Cl.[6] ..... A63B 55/00; A63B 57/00

[52] U.S. Cl. ..... 206/315.4; 206/315.3; 206/315.6; 150/159

[58] Field of Search ..... 383/3; 150/154, 150/159, 160, 900; 206/315.2, 315.6, 315.8, 522

[56] References Cited

U.S. PATENT DOCUMENTS

| | | | |
|---|---|---|---|
| 1,675,957 | 7/1928 | Reeves . | |
| 2,014,589 | 9/1935 | Saad | 150/1.5 |
| 2,023,792 | 12/1935 | Sampson | 206/315.4 |
| 2,704,563 | 3/1955 | Henrich | 206/315.4 X |
| 2,718,251 | 9/1955 | Barbato | 150/52 |
| 2,874,826 | 2/1959 | Matthews et al. | 206/1 |
| 2,907,580 | 10/1959 | Tietig | 280/179 |
| 2,998,601 | 8/1961 | Namsick et al. | 343/720 |
| 3,044,608 | 7/1962 | Bachleder et al. | 206/46 |
| 3,072,022 | 1/1963 | Wood et al. | 89/1.7 |
| 3,098,563 | 7/1963 | Skees | 206/46 |
| 3,316,951 | 5/1967 | Jacobson | 206/315.4 X |
| 3,460,597 | 8/1969 | Daly | 206/315.4 |
| 3,521,689 | 7/1970 | Woods, Jr. | 150/159 |
| 3,620,276 | 11/1971 | Taylor | 150/159 |
| 3,747,654 | 7/1973 | Wilson | 150/1.5 R |
| 3,754,587 | 8/1973 | Rainieri | 150/52 G |
| 3,883,053 | 5/1975 | Pritchard et al. | 224/5 P |
| 3,985,171 | 10/1976 | Summers et al. | 150/159 |
| 4,174,747 | 11/1979 | Boles | 150/1.5 R |
| 4,195,677 | 4/1980 | Hagg et al. | 150/82 G |
| 4,215,778 | 8/1980 | Kovins | 206/314 |
| 4,234,025 | 11/1980 | Berge | 150/160 X |
| 4,383,563 | 5/1983 | Kirchhoff, Jr. | 206/315.2 |
| 4,402,355 | 9/1983 | Wymore et al. | 150/52 R |
| 4,453,632 | 6/1984 | Clower | 206/315.4 |
| 4,489,833 | 12/1984 | Bauer | 383/3 X |
| 4,498,579 | 2/1985 | Brick | 206/315.4 |
| 4,503,558 | 3/1985 | Lief et al. | 383/3 |
| 4,512,465 | 4/1985 | Jobe | 206/315.4 |
| 4,569,082 | 2/1986 | Ainsworth et al. | 383/3 |
| 4,574,953 | 3/1986 | Garbuzov | 206/522 |
| 4,596,328 | 6/1986 | Solheim | 206/315.6 |
| 4,600,100 | 7/1986 | Solheim | 206/315.6 |
| 4,767,001 | 8/1988 | Kim | 206/315.3 |
| 4,881,638 | 11/1989 | Cho | 206/315.3 |
| 5,188,243 | 2/1993 | Ruiz | 211/70.2 |
| 5,209,280 | 5/1993 | Gevas | 206/315.4 X |
| 5,311,987 | 5/1994 | Shin | 206/315.6 |
| 5,421,454 | 6/1995 | Chern | 206/315.6 |
| 5,450,958 | 9/1995 | Shin | 206/315.6 |
| 5,490,594 | 2/1996 | Rupe | 206/315.4 |

FOREIGN PATENT DOCUMENTS

| | | | |
|---|---|---|---|
| 1141941 | 11/1960 | Austria . | |
| 238365 | 8/1986 | Germany . | |
| 3820197 | 12/1989 | Germany . | |
| 4311476 | 11/1992 | Japan . | |
| 615020 | 1/1994 | Japan . | |
| 26505 | 7/1906 | United Kingdom . | |
| 16996 | 7/1910 | United Kingdom | 150/154 |
| 980829 | 1/1965 | United Kingdom . | |

*Primary Examiner*—Sue A. Weaver
*Attorney, Agent, or Firm*—Michael G. Johnston; Richard W. Evans; Moore & Van Allen, PLLC

[57] ABSTRACT

A protective device for covering and protecting golf clubs in a golf bag comprises an inflatable body portion, the body portion comprising a tubular sleeve having a closed end and an open end for slipping over the golf clubs, and a valve for inflating the body portion wherein the inner body portion is shaped to the contour of the clubs for enveloping and resiliently securing the head and upper shaft portions of the golf clubs against movement. The inner and outer walls of the body portion are sealed together at their peripheral edges, and at a plurality of points over their respective areas forming a plurality of fluid chambers, preferably in fluid communication with each other, for conforming to the clubs. The golf club protective device may also be secured to the inside of a conventional golf bag cover, whether the cover is of the travel bag type fully enclosing the golf bag, or a hood enclosing only the club heads and the upper end of the golf bag.

18 Claims, 7 Drawing Sheets

INFLATABLE GOLF CLUB PROTECTOR

BACKGROUND

This invention relates generally to a golf club protector, and more particularly concerns a protective cover for golf clubs having an inflatable feature for enveloping and protecting the clubs during transport and storage.

Various types of protective covers have been used for enclosing and protecting golf clubs and golf bags. Golfers have traditionally protected the heads of their golf clubs with individual club head covers fitted over each club head. The club head covers provide protection as between individual clubs to avoid nicking and marring occurring as a result of jostling during carrying of the bag, or when picking up or laying down the golf bag.

When golf clubs are transported as during travel, a bag cover is used to protect and retain the golf clubs within the bag. Conventional bag covers include hoods and travel bags. Hoods are positioned over the ends of the clubs protruding from the golf bag and secured to the top of the bag, for example, by means of snaps, and may have one or more zippered openings. Travel bags are usually oversized flexible bags made from canvass or the like into which a golf bag is placed and thereafter closed, for example, by means of a zipper. Another, more cumbersome type of travel bag is made of hard plastic, in the manner of golf bag-shaped suitcase.

Unfortunately, few conventional protective golf bag covers mobilize the clubs from sliding, banging, and rattling around in the bag and causing damage to each other. Even where golf bags consist of individual tubes for each club shaft, preventing the shafts from contacting each other, the heads of the clubs are still free to swing and clash with one another. Consequently, the heads of the clubs suffer damage and receive marks. This shortcoming of conventional golf bag covers is even more manifest during transport. For example, when clubs are transported on a commercial airline the golf bag is usually subject to numerous handling and transfer operations between the terminal and aircraft. Of course, similar damage from careless handling is not limited to airline travel, but can also include bus travel, hotels, golf courses or even just throwing the clubs into the mink of the car.

Protection of golf clubs while on the course during constant drizzle or a sudden shower is also necessary. The golfer must cover the clubs to protect them and the bag from an accumulation of water. Golf clubs must be kept dry in order for the golfer to be able to grip the clubs without slippage, keep the finish on the clubs from deteriorating and to prevent rust and corrosion. Thus, it is also common to have a protective hood to fit over the clubs and bag in case of rain while playing. Golf bag hoods, such as those described above, which attach to the top of the bag and cover the club heads may be used for rain protection. However, these hoods are bulky and cumbersome and require manipulation of fastening devices which are difficult to work during rushed conditions.

For the foregoing reasons there is a need for a golf club cover which will protect golf clubs in a golf bag from damage during transport and storage. The cover must protect the clubs as amongst themselves during harsh treatment and restrain the movement of the clubs from the bag. Ideally, the golf club cover will also protect the clubs from rain or other deleterious weather conditions. The golf club cover should be simple and convenient to use and cost efficient to manufacture.

SUMMARY

The present invention is directed to a device that satisfies these needs. A protective device for covering and protecting golf clubs in a golf bag having features of the present invention comprises an inflatable body portion, the body portion comprising a tubular sleeve having a closed end and an open end for slipping over the golf clubs, and means for inflating the body portion wherein the inner body portion is shaped to the contour of the clubs for enveloping and resiliently securing the head and upper shaft portions of the golf clubs against movement. The inflating means comprises a valve for inflating the body portion with a fluid. The inner and outer walls of the body portion are sealed together at their peripheral edges, and at a plurality of points over their respective areas forming a plurality of chambers, preferably in fluid communication with each other. The golf club protector of the present invention may further be provided with means for removably attaching the device to the golf bag.

The aforementioned problems may also be solved in accordance with the present invention by securing the body portion of the golf club protector to the inside of a conventional golf bag cover, whether the cover is of the travel bag type fully enclosing the golf bag, or a hood enclosing only the club heads and the upper end of the golf bag.

Accordingly, it is an object of the present invention to provide a new device for protecting golf clubs having one or more of the novel features of the present invention as set forth above or hereinafter shown or described.

Another object of the present invention to provide an improved means for protecting golf equipment, particularly golf clubs.

Further, an object of the present invention is to provide means for protecting golf clubs during transportation and storage.

Still further an object of the present invention is to provide a golf club protective device which immobilizes the clubs and substantially prevents them from moving relative to each other and damaging the adjacent club heads and shafts.

A related object of the present invention is to provide a protective golf club cover which fits over the golf clubs and forces the clubs to remain in the bag during transport.

Yet another object of the present invention is to provide a golf club cover which protects the clubs and bags from moisture and dirt.

Also an object of the invention is to provide a protective golf club cover which is constructed so that it may be readily applied to golf bags of different sizes without modification.

Finally, it is an object of the invention to provide a golf bag cover which is easy to use, cost efficiently manufactured and is long-lasting and durable in use.

A feature of the present invention is the two relatively thin sheets of gas impervious material comprising the walls of the body portion which are sealed to each other in such a way that they confine a layer of fluid between them. The walls are connected at various points across their respective areas for forming separate fluid chambers. The fluid chambers of the inflated cover conform to and resiliently grip the clubs against movement and protect the clubs from outside forces during transport and storage. Because the cover is pliable, when not in use it is folded into a compact package which may be carried in a pocket normally provided on the side of a golf bag. Another feature of the present invention is means for attaching the cover to the bag and securing the clubs within the bag even when the bag is inverted.

Thus, a new protective device for golf clubs is provided embodying an inflatable cover which will protect golf clubs in a bag from damage during transport and storage. The inflatable golf club cover protects the clubs by restraining the movement of the clubs in the bag and cushioning the clubs from outside forces. The design of the present invention allows the cover to be fitted to any size bag or club configuration. The cover may be easily and quickly placed over the clubs and on the bag, for example to protect the clubs during adverse weather conditions, and is easy to remove and store.

BRIEF DESCRIPTION OF THE DRAWINGS

For a more complete understanding of this invention reference should now be had to the embodiments illustrated in greater detail in the accompanying drawings and described below.

In the drawings.

DESCRIPTION

Figure 1:
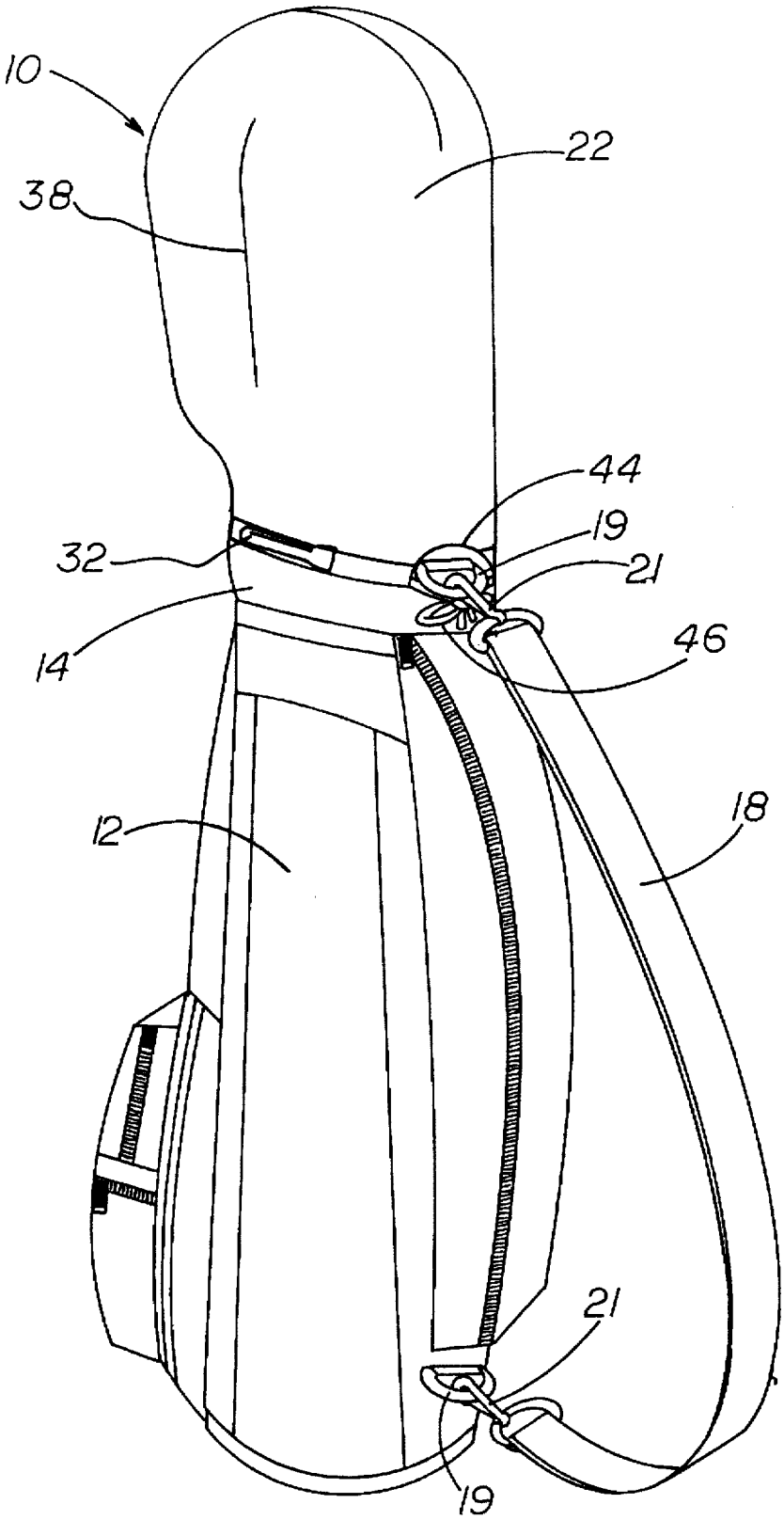
FIG. 1 is a perspective view of a golf bag according to this invention showing the protective golf club cover in operative position on a golf bag and clubs.
Figure 9:
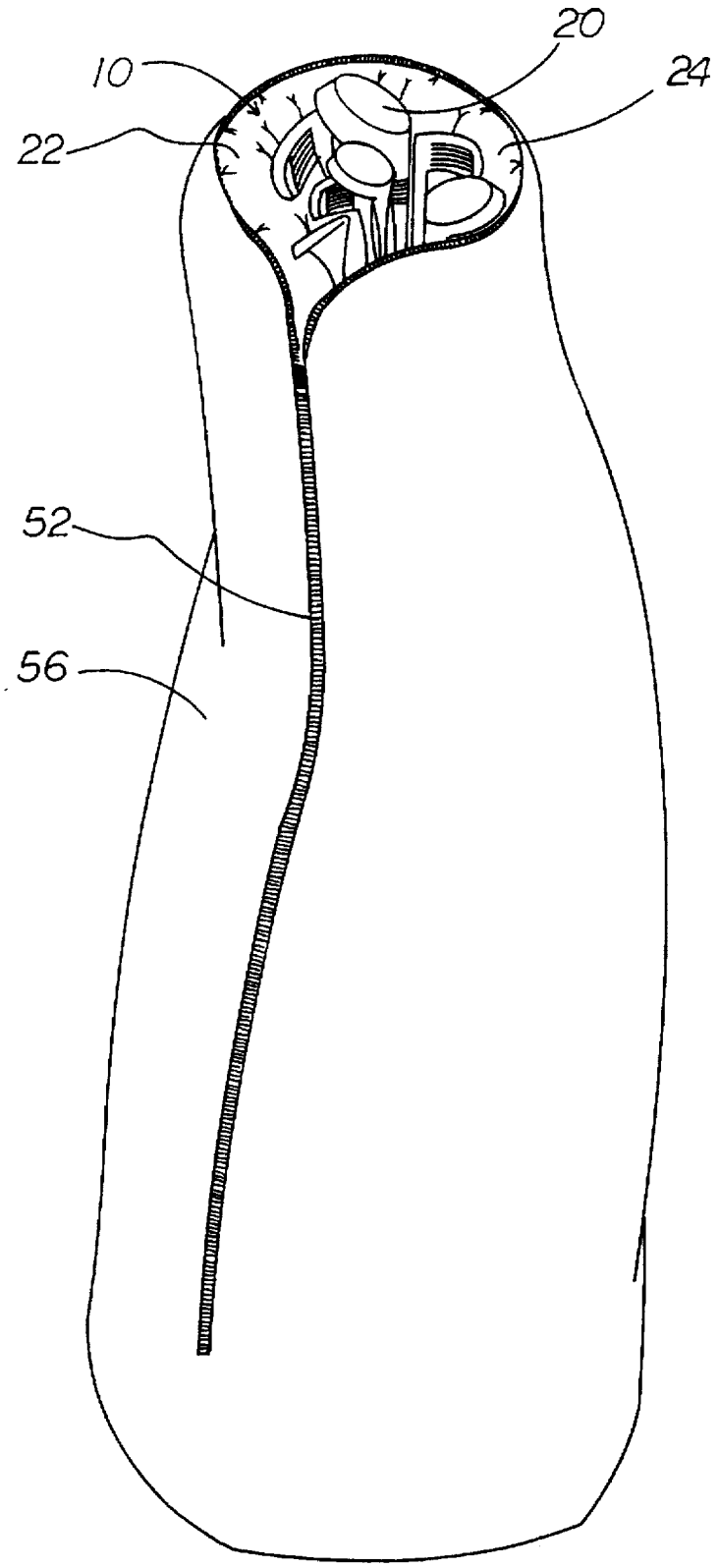
FIG. 9 is a perspective view of a golf bag according to this invention showing the embodiment of the protective golf club cover of FIG. 8, the cover being inflated and the travel bag in operative position on a golf bag and clubs.

FIG. 1 shows an embodiment of the present invention, generally denoted at 10, in position on top of a conventional golf bag 12. The golf bag 12 shown is illustrative of the general construction of a golf bag having an open top generally defined by a collar 14. As is customary, various types of attachment belts or loops and connector rings are secured to or mounted on the bag for interconnection with various types of accessories. Typically, a shoulder strap 18 is attached to two of the rings 19 by means of snap hooks 21. The bag 12 contains the usual assortment of clubs 20, notably woods, irons, and a putter as shown in FIG. 9, which may or may not be covered by individual head covers.

Figure 2:
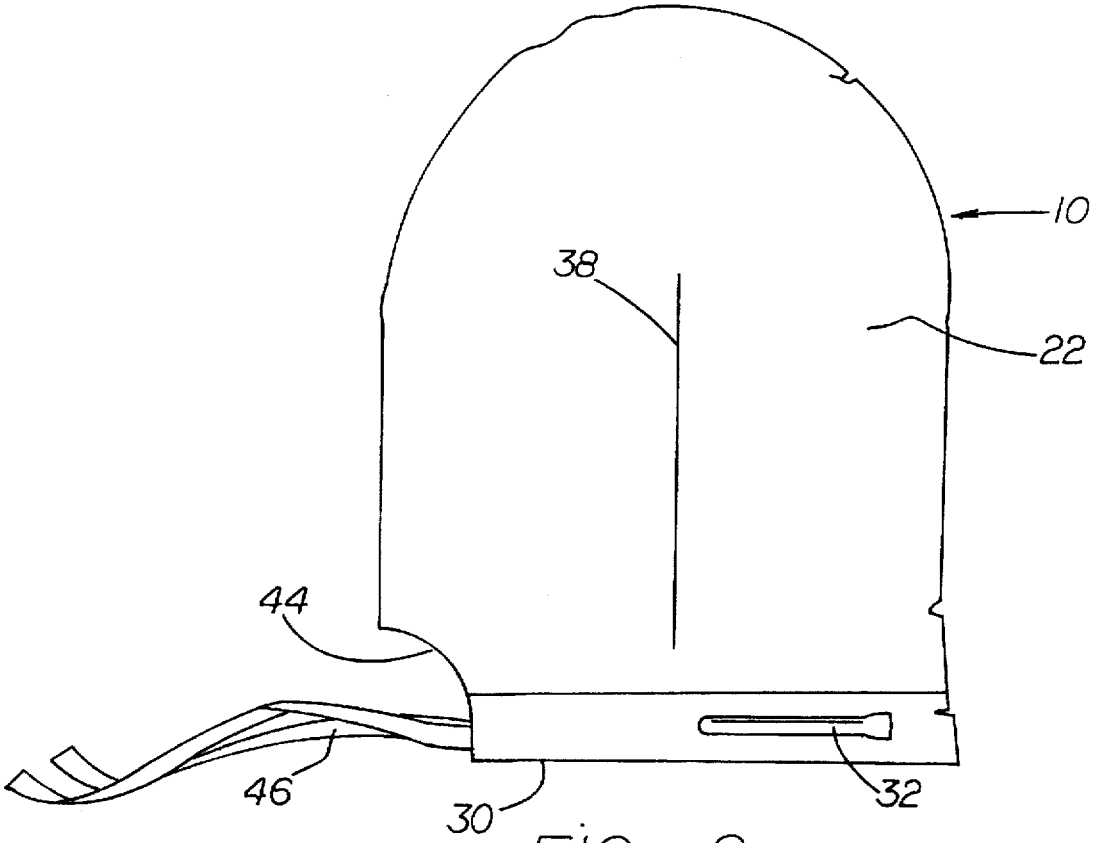
FIG. 2 is a side elevational view of an embodiment of the protective golf club cover of the present invention, the cover being deflated to show the details of construction.

Referring to FIGS. 1 and 2, the present invention comprises a protective device 10 for use as an accessory to a golf bag 12 for covering and protecting golf clubs therein by preventing the clubs from hitting and damaging each other. The protective cover 10 comprises an inflatable body portion 22 formed of a pliable, inflatable material such as a rubberized fabric. The body 22 includes inner and outer wall portions 24, 26 defining a chamber for receiving a fluid under pressure. The wall portions are joined along the side and top portions of the body 22 to form a closed sleeve having an open lower end 30 representing a flat tubular configuration. The cover of the present invention 10 thus defines an object receiving chamber that can be slipped over the top of the golf bag 12 and the clubs into engagement with the open top end of the golf bag 12 forming a semicircular dome encircling and enveloping the clubs. The cover 10 is sufficiently large that it fits over the open ends of golf bags of varying sizes. An air valve 32 is fitted to the body 22 for inflating the body to grip and immobilize the clubs. This also provides cushioning for the clubs as means for absorbing the forces generated when the bag 12 and clubs are handled and transported. In this arrangement, the clubs are also protected from injury by contact with foreign objects and weather damage.

Figure 4:
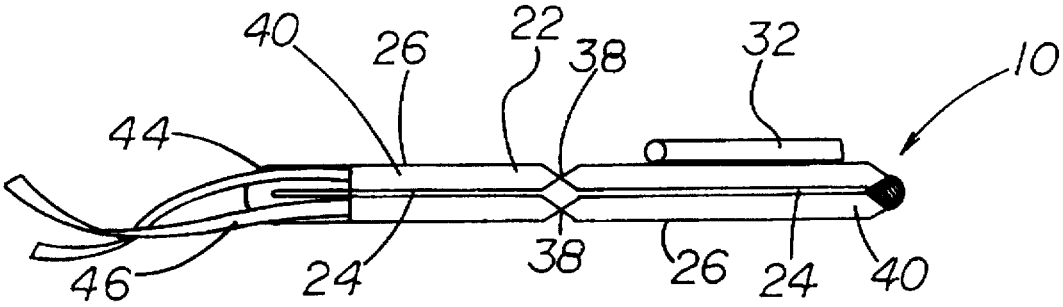
FIG. 4 is a longitudinal view of an embodiment of the protective golf club cover of the present invention, the cover being deflated.
Figure 5:
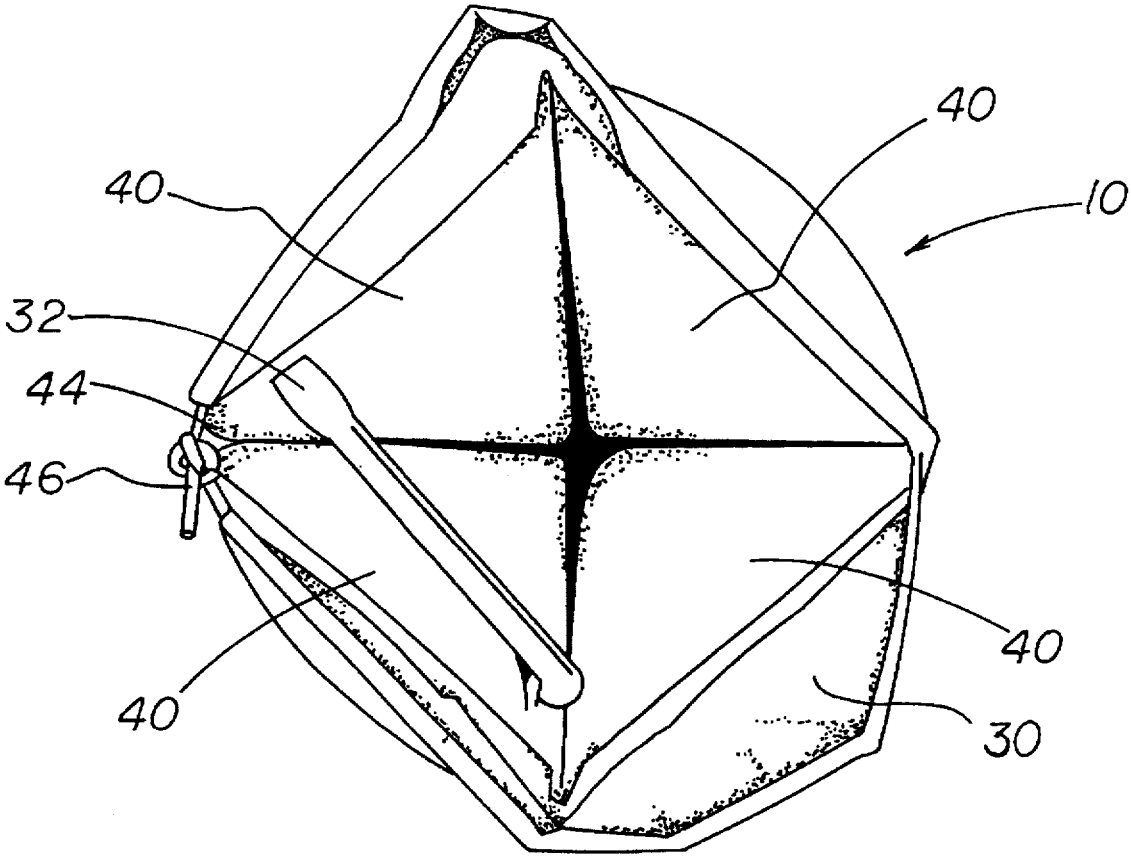
FIG. 5 is a longitudinal view of the embodiment of the present invention as shown in FIG. 4, the cover being inflated showing the protective feature of the invention.

The inner and outer wall portions 24, 26 of the cover 10 are substantially the same size and same connected half-oval arcuate shape. The side walls 24, 26 are sealingly joined at their peripheral edges forming an inflatable chamber which may be pressurized by any convenient means through the valve 32. As shown in FIGS. 4 and 5, when the protective cover 10 is deflated, the outer wall 26 tends to lie along the inner wall 24. Upon inflation, the chamber defined by the walls fills and the walls 24, 26 separate and resiliently grip any object inserted within the cover 10 and provide shock-absorbing support thereto. As the inner wall 24 contacts an object it tends to conform to and partially envelop the object. It is thus understood that the inner wall 24 will form naturally almost any desired shape as it is inflated depending on the shape and configuration of the object or objects about which it expands.

The walls 24, 26 of the body portion 22 are preferably fabricated from a flexible, fluid impervious material, such as regularly available synthetic materials having the further characteristics of strength and durability to withstand the handling of the bag 12 during transport and storage. The material should be thin so that it is flexible, which is possible because when the cover 10 is inflated the structure of the cover is maintained by fluid pressure. In practice, the cover 10 has been constructed of a vinyl material due to its preferably flexible and durable nature and ability to expand when inflated to grip the surfaces of the clubs. Vinyl is not affected by moisture and is easy to clean. However, any sheet of material that is reasonably tough and airtight is suitable for use as the cover material in the present invention. Rubber or nylon fabric may be used, as well as thermoplastic fills; for example a polyolefin, such as polyethylene or polypropylene, polyester, polyvinyl, polycarbonate, polyamide, or the like. Further, such materials as metal foil to paper laminates, metal foil to plastic fill laminates, metalized plastic films, and the like, and even certain types of paper may also be used. The scope of the invention is not intended to be limited by the materials listed here, but may be carried out using any material which allows the construction and operation of the protective golf club cover described herein.

Of course, it is understood that instead of a single material, each of the inner wall 24 and outer wall 26 may be constructed of different materials as long as the materials are airtight to properly function as the inflatable golf club cover 10 of the present invention. The outer wall 26 material may also be water repellent for protection against moisture in which case the uninflated cover may be used as a hood to protect the bag and clubs from rain while playing. The composition of the cover 10 may also include additional outer or inner wall layers. For example, a second layer of outer wall material may be added which is extremely durable and water repellant. Additional inner wall layers can be made soft and resilient for further protection of the clubs.

Figure 3:
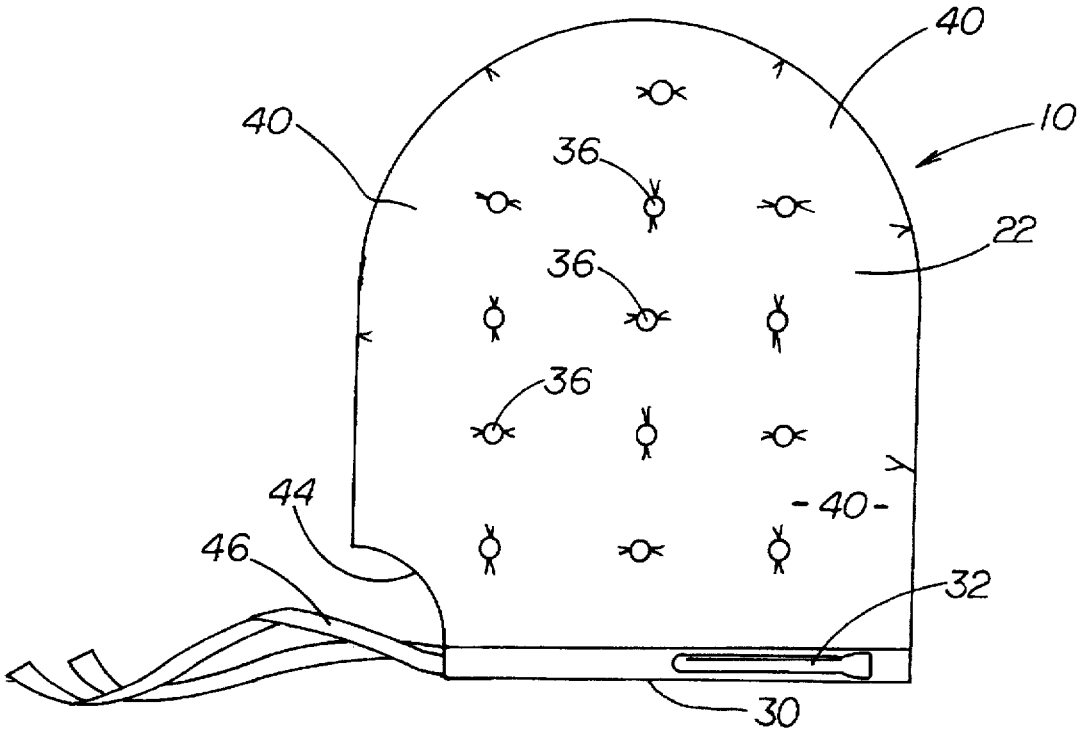
FIG. 3 is a side elevational view of another embodiment of the protective golf club cover of the present invention wherein the walls of the body portion forming the confined volume are sealed together at spaced points, the cover being deflated to show the details of construction.
Figure 8:
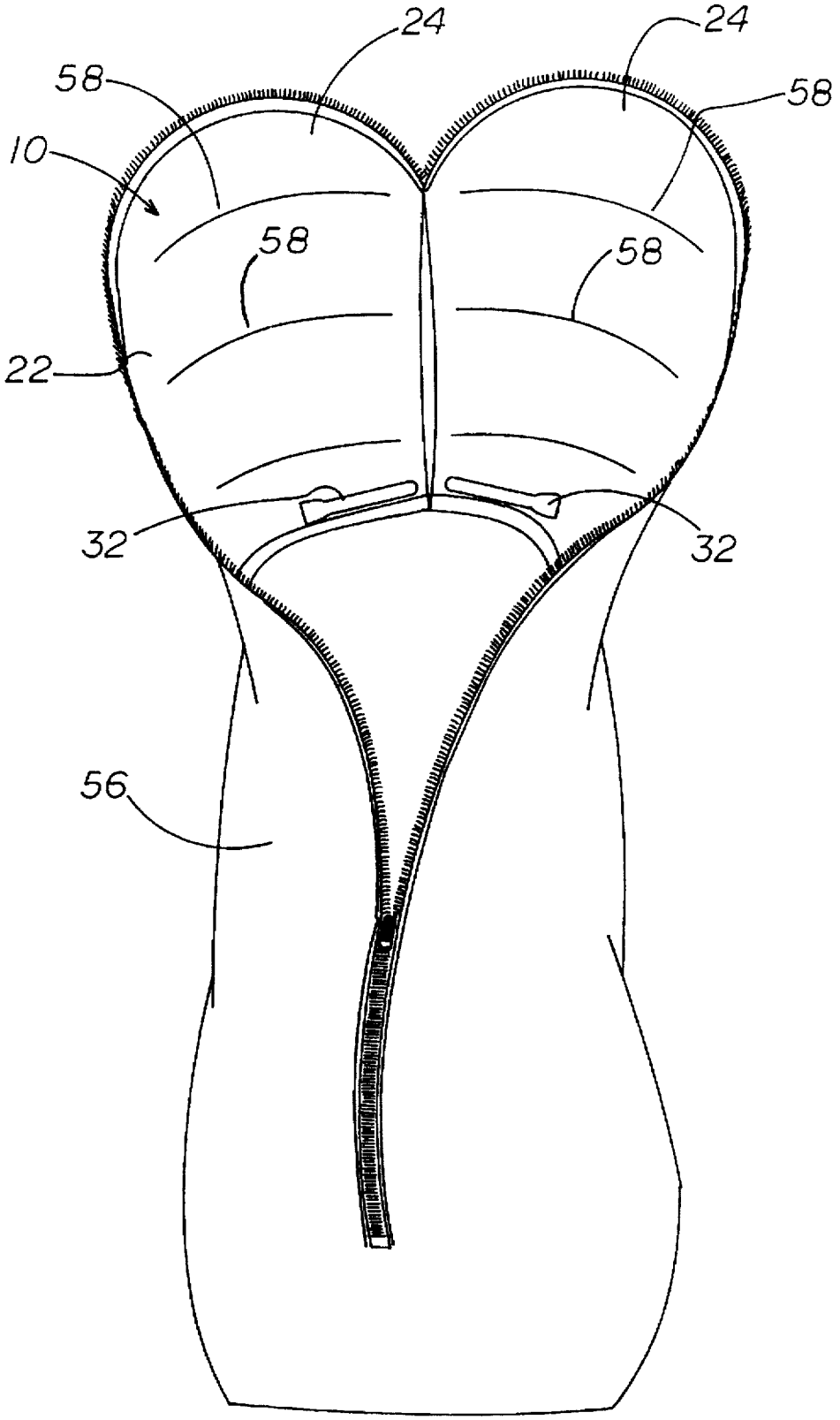
FIG. 8 is a side elevational view of still another embodiment of the protective golf club cover of the present invention secured to the interior of a conventional golf travel bag, one half of the cover secured to the interior of each side of the travel bag.

The protective golf club cover 10 is formed by overlying the inner and outer walls 24, 26 which have been cut to the proper pattern. The walls 24, 26 are then sealed along their peripheries by a fluid tight seal using any known fabrication technique applicable to such material, such as a suitable adhesive, heat seal, pressure stamp, or combinations thereof. Fabrication techniques may further incorporate the use a stitched seam reinforced construction to enhance the strength of the unit. As best shown in FIGS. 2 and 3, once the sheets of inner 24 and outer wall 26 material have been joined together about their respective outer edge portions, the walls 24, 26 are preferably sealed at various points 36 or along interrupted lines 38 over their common area to form a plurality of separate inflatable, shock absorbing chambers 40. The wall connecting means 36, 38 form the divisions of the chambers 40 and, in the case of interrupted lines 38, may comprise stitched seam segments at several points along the device 10. The positioning of the wall connecting means 36, 38 separate and determine the size of the chambers 40. It is understood that the device 10 can be constructed with any number of chambers 40 which vary depending on the spacing and the number of inner and outer wall connections 36, 38 formed. The thickness of the inflated cover 10 is also determined by the distance between the sealed points 36 or lines 38, as well as by the pressure of the confined fluid. Preferably, vertical seams 38 are placed about 5 to about 10 inches apart around the periphery of the cover (FIG. 2). Alternatively, the cover may comprise a spot welded construction, as shown in FIG. 3, or a series of horizontal seams 58 (FIG. 8). The preferred cover 10 configuration comprising a plurality of chambers 40 enables the cover 10 to better conform with the shape and contour of the clubs. Additionally, each chamber 40 is preferably open at at least one point to another chamber 40 so that all of the chambers are pneumatically interconnected to one another to effect inflation of the cover 10 from a common source. In other words, the points 36 and lines 38 do not intersect in such a way as to isolate any part of the potential space between the walls 24, 26 from any other part.

The protective golf club cover 10 is designed to be of sufficient length to at least cover the upper ends of the clubs and engage the upper collar 14 of the bag 12. Although golf bags vary considerably in size and shape, and clubs come in different lengths, the design of the present invention enables the cover 10 to be adaptable to accommodate any size and combination of golf bag and clubs without modification.

The valve 32 for inflation and deflation of the protective device 10 is fitted within the inner wall 24 or outer wall 26 of the body 22. Any conventional valve is appropriate, such as a tire or life jacket valve or needle type valve which is commonly used with basketballs, footballs and the like. Accordingly, the device 10 may be pressurized via the valve 32. The pressurizing fluid is preferably a gas, and more preferably a commonly available gas such as air. The device 10 may also be inflated using a liquid, such as water, but is much heavier when so inflated and is difficult to sufficiently pressurize. Inflation with air is easily accomplished by mouth, a hand pump attachment or aerosol can. Because the confined volume of the chambers 40 defined by the walls 24, 26 of the body 22 are pneumatically interconnected, charging at a single point permits a simultaneous charging of the entire volume.

It is understood that securing the protective cover 10 to the golf clubs is accomplished by means of fluid pressure. Alternatively, means for removably attaching the device to the top of the bag may be provided. For example, the protective cover 10 shown in FIGS. 1–5 includes a notch 44 for circumposing the upper shoulder strap ring attachment 19 and a drawstring 46 to be tied underneath the ring 19. The drawstring 46 may be firmly attached to the body portion 22 such as by cementing, heat welding, stitching, and the like. Optionally, male and female snap means may be provided interiorly of the open lower end of the body portion 22 to cooperate with opposed snap means on the golf bag which hold the device in position atop the golf bag 12. It is understood that other attaching means are also available for use in the present invention, including a zipper added to the lower seam of the cover, a pressure sensitive fastener such as VELCRO, an elastic band around the bottom of the body portion 22, and the like, so the cover 10 may be securely fastened over and to the collar 14 of the golf bag 12.

The use of the protective cover 10 on a conventional golf bag 12 is illustrated in FIG. 1. To apply the cover 10 to the bag 12 the open bottom portion of the cover is slipped over the club heads and drawn downwardly around the bag 12 until the lower end of the cover 10 is in engagement with the top collar 14 of the golf bag. Attaching means, if used, secures the device in position, in this case by way of the drawstring 46 which is pulled into position and tied underneath the shoulder strap ring 19. The body portion 22 of the cover 10 is thereby forced to conform to the outside of the golf bag 12. This completes the installation of the cover 10 to the top of the bag 12. In this position, the protective cover 10 covers the top of the bag 12 and shields the interior keeping the clubs dry and dust-free. Subsequently, the cover 10 is inflated by connecting the end of the valve 32 to a source of fluid, for example, the user's mouth or a nozzle of an air supply tube. Because the flexible material is fluid impervious, the side walls 24, 26 of the cover expand and clearance between the cover 10 and clubs is eliminated. The degree of inflation is sufficient to grip and immobilize the clubs and prevent any displacement thereof. When inflated, the cover 10 assumes any shape that the clubs within the bag constrain it to and adapts itself to all of the irregularities of the clubs. The inflated cover 10 is sufficiently non-collapsible so as to retain its cross sectional configuration and act as a cushion to protect the clubs from impact in the event of abusive handling or dropping. Any outside forces, shocks and vibrations will be absorbed by the cushioned interior of the cover 10 thus precluding any damage which might result to the clubs. When it is desired to take the cover 10 from the bag 12 the reverse operation is very simple and expeditious.

The cover 10 of the present invention is sufficiently thin and flexible so that it can be conveniently folded into a small package and when not in use carried in one of the pockets of the golf bag 12. When it rains, the cover is quickly removed from the pocket and attached to the bag 12 by securing the drawstring 46 around the shoulder strap ring 19 preventing rain leakage into the bag.

Figure 6:
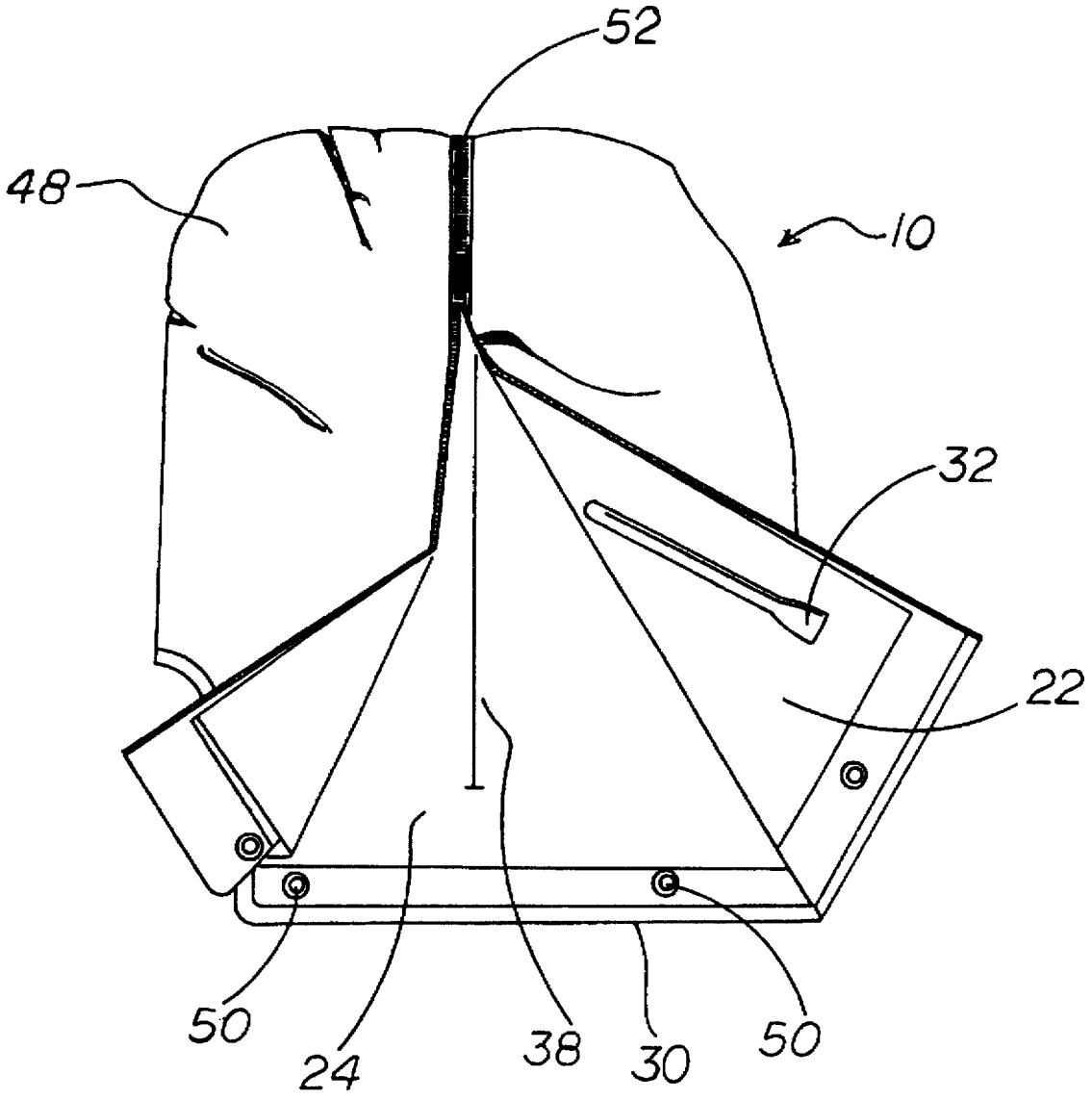
FIG. 6 is a side elevational view of another embodiment of the protective golf club cover of the present invention secured to the interior of a conventional golf bag hood, the cover being deflated to show the details of construction.
Figure 7:
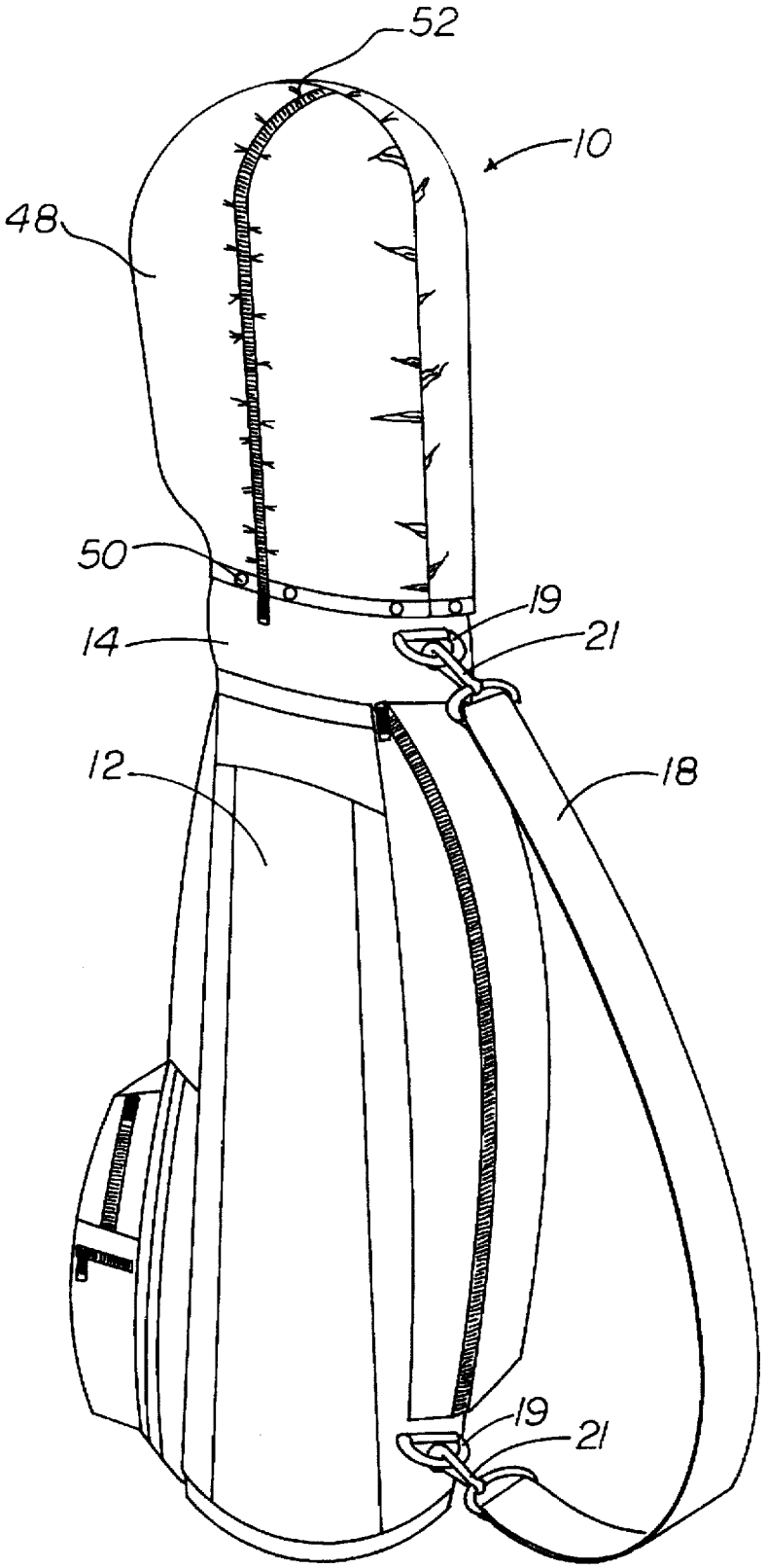
FIG. 7 is a perspective view of a golf bag according to this invention showing the embodiment of the protective golf club cover as in FIG. 6 in operative position on a golf bag and clubs.

In another embodiment of the present invention, the protective golf club cover 10 is suitably attached, such as by adhesives, stitching, VELCRO, and the like, to the interior of a conventional golf bag hood cover 48 (FIGS. 6 and 7). As described above, the standard golf bag hood cover 48 fits closely over the top of the golf bag 12 and is typically held in place by a series of snaps 50 of the male and female type. Sometimes the hood 48 includes one or more zippers 52 for closing the hood 48. In this embodiment of the present invention, the opposed sides of the cover 10 may only have a short common peripheral edge at the top or one side of the cover 10 for a close fit to the unzipped hood 48 structure, which also makes it easier to mount the combined hood 48 and cover 10 to the clubs and bag 12. Alternatively, one half of the cover 10 may be attached to each side of the hood 48 and a dedicated valve 32 secured in each half. The result is a golf bag hood cover 48 that fits onto the golf bag 12 fitted with an internal lining comprising the protective cover 10 of the present invention. Inflation of the cover 10 provides the same protection as outlined above.

In a similar embodiment, the protective cover 10 may be provided as an interior liner of a conventional golf bag travel bag 56. In this embodiment, as shown in FIGS. 8 and 9, the cover 10 is affixed to and forms and an integral inflatable upper end of the travel bag 56. The cover 10 acts in cooperation with the travel bag 56 to protect the clubs from harm from external forces which might be encountered during handling, transportation or storage. The cover 10 is sized so that it is adapted to fit inside of the travel bag and surround the golf clubs. For this use the cover 10 preferably comprises a series of horizontal seams 58 forming the air chambers 40 which configuration minimizes the shortening of the cover 10 and associated bag 56 as the cover 10 is inflated. As with the combined hood 48 and cover 10 embodiment, the cover 10 may have a short common peripheral edge on one side of the device 10, or, as shown in FIG. 8, one half of the cover 10 may be attached to each side of the bag 56 and a valve 32 associated with each half. In both the hood 48 and travel bag 56 embodiments, the cover 10 can be removably attached therein for convenient cleaning or repair should this be necessary.

The protective golf club cover of the present invention has many advantages including the protection of golf clubs in a golf bag, and more particularly the shafts and heads thereof, from damage due to external forces normally occurring as a result of rough handling during transport. This advantage offered by the cover of the present invention is achieved by virtue of a surrounding pneumatic cushion. When the bag and clubs are handled, thrown or dropped the fluid pressure in the cover resists deformation and maintains the clubs in close, immobile contact with one another preventing damage. The momentum of the bag does not affect the clubs nor result in deleterious engagement with one another. Further, with the present cover installed on and attached to the golf bag, if the golf bag is turned upside down the clubs will be maintained in position. Thus, the device protects the clubs even in an inverted position such as would be encountered when a bag is dropped or thrown during baggage handling. The protective cover is adaptable to protect all shapes and sizes of bags and clubs from damage, is easy to use and may be quickly slipped over the top of the bag. In the event of a shower during play, the golfer may remove the cover from its storing place, preferably a golf bag pocket, and position it on the bag and clubs. The cover may also be used in cooperation with a traditional golf bag hood or travel bag as an interior lining therefor. The cover is relatively simple in construction yet provides a degree of protection not heretofore obtainable when transporting golf clubs and bags with or without a travel bag or cover.

While the present invention has been described in considerable detail in connection with particular embodiments thereof, it will be understood, of course, that I do not intend to limit the invention to those embodiments since modifications may be made by those skilled in the art, particularly in light of the foregoing teachings. On the contrary, I intend to cover all alternatives, modifications and equivalents as incorporate those features which constitute the essential features as may be included within the spirit and scope of the invention as defined by the appended claims.

I claim:

1. A protective device for covering and protecting golf clubs in a golf bag, the golf club protector comprising:

an inflatable tubular body portion, the body portion comprising fluid impervious flexible inner and outer walls sealingly secured together to form an inflation chamber for receiving and holding a fluid, a closed end and an open end, the open end of the body portion adapted for receiving the golf clubs, and means for inflating the body portion, wherein the body portion, when inflated, is adapted to envelope and resiliently secure the golf clubs against movement relative to one another and cushion the clubs against outside forces, and, when deflated and not in use, the body portion is adapted for compacting by at least one of folding, rolling, or wadding up for storage in a pocket of the golf bag.

2. A golf club protector as recited in claim 1, wherein the inner and outer walls are sealed together at a plurality of locations over their respective areas, thereby dividing the inflation chamber into a plurality of fluid chambers.

3. A golf club protector as recited in claim 2, wherein the plurality of sealed locations are formed by stitched seams.

4. A golf club protector as recited in claim 2, wherein the plurality of sealed locations are formed by discrete sealed points.

5. A golf club protector as recited in claim 2, wherein the plurality of fluid chambers are in fluid communication with each other.

6. A golf club protector as recited in claim 1, wherein the inflating means comprises a valve for inflating the tubular body portion with a fluid.

7. A golf club protector as recited in claim 1, further comprising means for removably attaching the golf club protector to the bag.

8. A golf club protector as recited in claim 7, wherein the attaching means comprises a drawstring around the periphery of the open end of the body portion.

9. A golf club protector as recited in claim 7, wherein the attaching means comprises an elastic band around the periphery of the open end of the body portion, the band sized to be expanded to fit over the golf clubs and golf bag.

10. A golf club protector as recited in claim 7, wherein the attaching means comprises a fastener material affixed to the open end of the body portion and the top of the golf bag for fastening the body portion to the golf bag.

11. The golf club protector as recited in claim 7, wherein the attaching means comprises snaps on the golf club protector cooperating with snaps on the golf bag.

12. A golf club protector as recited in claim 1, wherein the body portion is adapted to be secured to the inside of a golf bag cover.

13. A golf club protector as recited in claim 12, wherein the golf bag cover encloses the golf clubs and is removably attached to the upper end oft he golf bag.

14. A golf bag cover for fully enclosing and protecting a golf bag and golf clubs in the golf bag, the golf bag cover comprising:

an inflatable tubular body portion secured to the inside of the golf bag cover, the body portion having inner and outer walls defining an inflation chamber for receiving and holding a fluid, and means for inflating the body portion, wherein the body portion, when inflated, envelopes and resiliently secures the golf clubs against movement relative to one another and cushions the clubs against outside forces.

15. A golf bag cover as recited in claim 14, wherein the inner and outer walls are sealed together at a plurality of locations over their respective areas, thereby dividing the inflation chamber into a plurality of fluid chambers.

16. A golf bag cover as recited in claim 15, wherein the plurality of sealed locations are formed by stitch seams.

17. A golf bag cover as recited in claim 15, wherein the plurality of fluid chambers are in fluid communication with each other.

18. A golf bag cover as recited in claim 14, wherein the inflating means comprises a valve for inflating the tubular body portion with a fluid.

* * * * *

UNITED STATES PATENT AND TRADEMARK OFFICE

CERTIFICATE OF CORRECTION

PATENT NO. : 5,704,475

DATED : January 6,1998

INVENTOR(S) : William Jack

It is certified that error appears in the above-identified patent and that said Letters Patent is hereby corrected as shown below:

At column 1, line 29, change "mobilize" to --immobilize--.
At column 4, line 58, change "fills" to --films--.
At column 4, line 61, change "fill" to --film--.
At column 8, line 64, change "oft he" to --of the--.

Signed and Sealed this

First Day of June, 1999

*Attest:*

Q. TODD DICKINSON

*Attesting Officer*

*Acting Commissioner of Patents and Trademarks*